US005715560A

United States Patent [19]

Banicki

[11] Patent Number: 5,715,560

[45] Date of Patent: Feb. 10, 1998

[54] SCRUB BRUSH WITH INTEGRAL HANDLE AND CLEANING ELEMENTS

[76] Inventor: Kathy Banicki, 1130 Burnham Rd., Bloomfield Hills, Mich. 48304

[21] Appl. No.: 801,609

[22] Filed: Feb. 18, 1997

[51] Int. Cl.[6] ..... A47L 13/10

[52] U.S. Cl. ..... 15/229.11; 15/209.1; 15/228

[58] Field of Search ..... 15/147.1, 195, 15/196, 209.1, 210.1, 226, 228, 229.1, 229.11, 229.13; D32/40, 45, 50, 51, 52

[56] References Cited

U.S. PATENT DOCUMENTS

| | | | |
|---|---|---|---|
| 31,586 | 3/1861 | Axe . | |
| 59,733 | 11/1866 | Wright | 15/195 |
| 62,742 | 3/1867 | Hadley . | |
| 613,683 | 11/1898 | Kemp . | |
| 763,888 | 6/1904 | Hayden . | |
| 1,115,165 | 10/1914 | Briggs | 15/196 |
| 1,341,526 | 5/1920 | Voss . | |
| 1,392,633 | 10/1921 | Gilman . | |
| 2,204,947 | 6/1940 | Apfelbaum . | |
| 2,230,312 | 2/1941 | Sieb et al. . | |
| 2,233,289 | 2/1941 | Hatzenbuehler . | |
| 2,263,883 | 11/1941 | Livermont . | |
| 2,635,274 | 4/1953 | Hatcher et al. . | |
| 2,916,759 | 12/1959 | Smith . | |
| 3,336,618 | 8/1967 | Day . | |
| 3,343,196 | 9/1967 | Barnhouse . | |
| 3,434,177 | 3/1969 | Parry . | |
| 3,877,103 | 4/1975 | Nash . | |
| 3,924,288 | 12/1975 | Breland . | |
| 4,987,634 | 1/1991 | Weihrauch . | |
| 5,199,130 | 4/1993 | Lazar . | |
| 5,205,012 | 4/1993 | Coley . | |
| 5,217,787 | 6/1993 | Monahan . | |

FOREIGN PATENT DOCUMENTS

| | | | |
|---|---|---|---|
| 409294 | 4/1910 | France | 15/229.13 |
| 194412 | 2/1938 | Switzerland | 15/195 |

*Primary Examiner*—Randall Chin
*Attorney, Agent, or Firm*—Dykema Gossett PLLC

[57] ABSTRACT

A scrub brush has an elongated handle with a first end and a second end which are connected to or integrally formed with a base which extends beyond the length and width of the handle. The handle forms an opening between the base and the handle so that the brush may be gripped. A mounting portion of the base is that portion of the base which extends beyond the length and width of the handle. The mounting portion preferably has a respective pair of holes for each of the cleaning elements. A plurality of cleaning elements are coupled to the base by looping the cleaning elements through its corresponding pair of holes so that the cleaning elements extend out from the portion of the base opposite that of the handle.

5 Claims, 1 Drawing Sheet

SCRUB BRUSH WITH INTEGRAL HANDLE AND CLEANING ELEMENTS

BACKGROUND OF THE INVENTION

The present invention is related to a scrub brush provided with an integral handle, and more specifically to a brush having a plurality of cleaning elements which are frictionally coupled to the base of the handle without the use of any adhesive or mechanical fastener.

Several brush-type cleaning tools are known in the art. Many have a single handle which extends from the brush portion. When cleaning surfaces, it is difficult to provide enough force on the brush portion of the tool since pressure is provided to the brush portion at one point. Only a small area directly opposite the handle has enough force to actually clean some hard to clean surfaces.

It is therefore desirable to provide a scrub brush through which a uniform distribution of force may be applied to the surface to be cleaned. It is also desirable for the brush to include a cleaning element which is strong enough to clean difficult to clean surfaces.

SUMMARY OF THE INVENTION

Briefly, the scrub brush of the present invention has an elongated handle with a first end and a second end. The scrub brush has a plurality of cleaning elements. A base is fixedly connected to the first end and to the second end of the handle so that a hand opening is formed between the base and the handle. The base has a width and a length both of which are wider and longer than the width and length of the handle respectively. The portion of the base extending beyond the length and width of the handle forms a mounting portion. The mounting portion has respective pairs of holes, each pair corresponds to one of the plurality of cleaning elements. Each of the plurality of cleaning elements are looped through a respective pair of holes so that each of the cleaning elements extend from the mounting portion a substantially equal distance from each of the respective pair of holes from the side of the base opposite the handle.

One feature of the invention is the use of nylon netting to form the plurality of cleaning elements. Nylon netting provides a durable and abrasive surface for cleaning.

One advantage of the present invention is that the cleaning elements extend from the base at locations which are just longer and wider than the handle. The advantage of such a configuration is that a more even distribution of force may be applied to the cleaning elements.

Another advantage of the present invention is that the brush is relatively easy to manufacture. No adhesive is required to hold the cleaning elements in place.

BRIEF DESCRIPTION OF THE DRAWINGS

Other features and advantages of the present invention will become apparent from the following detailed description which should be read in conjunction with the drawings in which.

DETAILED DESCRIPTION OF A PREFERRED EMBODIMENT

Figure 1:
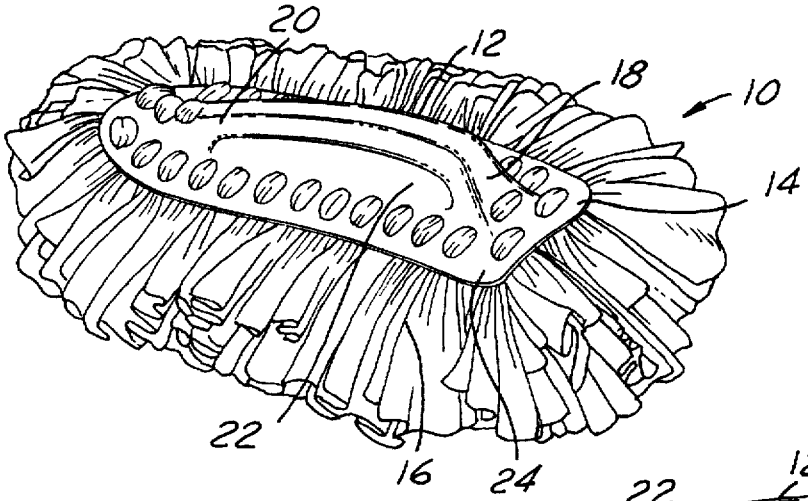
FIG. 1 is a perspective view showing the top and side of a scrub brush according to the present invention.

Referring now to the drawings, like reference numerals are used to identify identical components in the various views.

Figure 2:
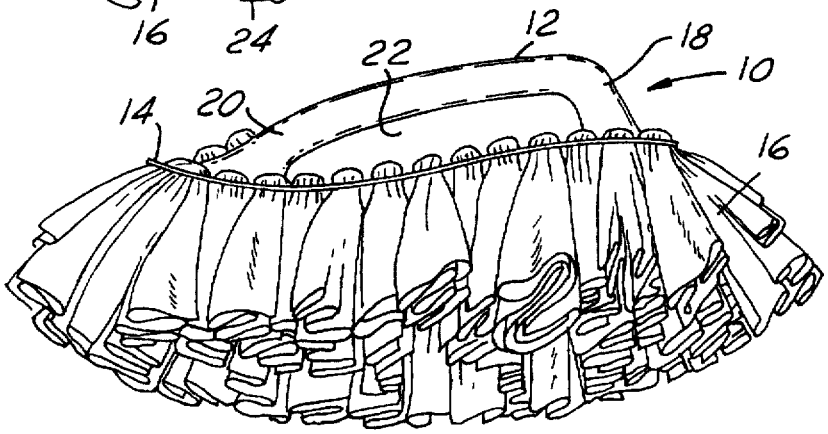
FIG. 2 is a perspective view showing the bottom and side of a scrub brush according to the present invention.

Referring now to FIGS. 1 and 2, a scrub brush 10 is shown having an elongated hollow handle 12 which is connected to a base 14. The base 14 has a plurality of abrasive cleaning elements 16 coupled thereto.

Handle 12 is preferably made of a plastic material. Handle 12 is also preferably hollow to reduce the weight of the scrub brush 10. Handle 12 has a first end 18 and a second end 20 which are affixed to or integrally formed with base 14. Handle 12 is shaped so that a hand opening 22 is formed between the handle 12 and base 14.

Base 14 is also preferably made of plastic and may be integrally formed with handle 12. Base 14 has a mounting portion 24 which extends beyond the length of handle 12 and beyond the width of handle 12. Mounting portion 24 is used to secure cleaning elements 16. Cleaning elements 16 may also be affixed to the portion of the base adjacent handle 12.

Cleaning elements 16 are preferably formed of a piece of nylon netting material. Nylon provides the advantage of resisting absorption of cleaning solvents and also provides an abrasive surface to clean hard to clean surfaces. If absorption of cleaning solvents is desired, a different material may be used. Cleaning elements 16 are each formed of a bunched up or rolled up piece of nylon netting. Cleaning elements 16 may, for example, be rectangular before being compressed. Cleaning elements 16 are preferably looped through mounting portion 24 of base 14 so that each end of cleaning elements 16 may contact the cleaning surface. To provide maximum cleaning surface area, each side of each cleaning element preferably extends an equal distance from mounting portion 24 of base 14.

Figure 3:
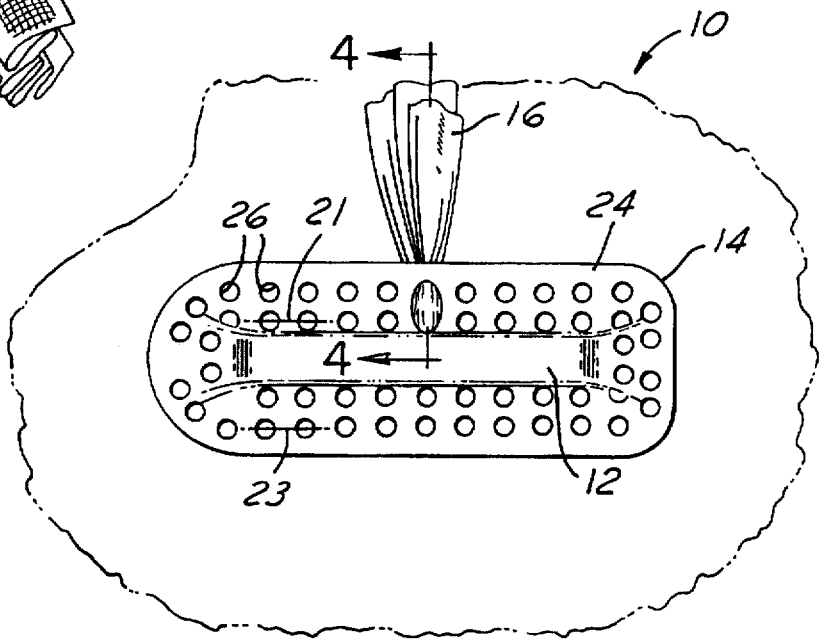
FIG. 3 is a top view of a scrub brush handle having one cleaning element inserted therein.

Referring now to FIG. 3, mounting portion 24 has a plurality of holes 26 extending therethrough. The mounting portion 24 of the base 14 is provided with an annular inner row 21 of holes 26 which is surrounded by an annular outer row 23 of holes 26. The holes 26 in each row are uniformly spaced part. The holes 26 in the outer row are aligned with the holes 26 in the inner row 21. Holes 26 are used to secure cleaning elements 16. Each cleaning element 16 has a respective pair of holes 26, one hole in the inner row 21 and an adjacent hole in the outer row 23. When each of the pairs of holes 26 are filled with a cleaning element 16, a substantially even distribution across base 14 may be applied through handle 12 to maximize the effective cleaning area of scrub brush 10. Additional pairs of holes with cleaning elements may be provided at the ends of the mounting portion 24.

Figure 4:
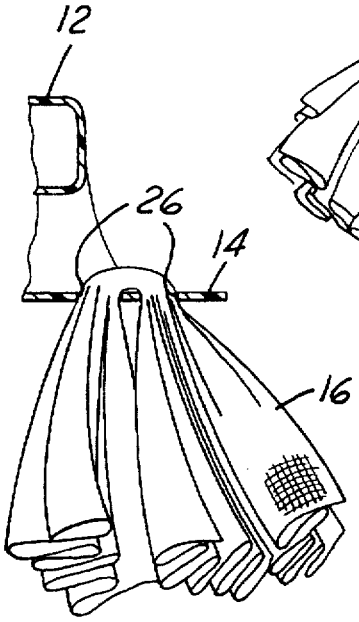
FIG. 4 is a partial cross-sectional view of a scrub brush taken on the line 4—4 of FIG. 3.

Referring now to FIG. 4, a portion of a hollow handle 12 is shown with respect to a pair of holes 26 in mounting portion 24 of base 14. To assemble cleaning elements 16 into holes 26, a rolled or compressed piece of nylon is pulled through one of holes 26 and looped around the handle side of base 14 and pulled through its other respective hole 26. After being released in holes 26, cleaning element 16 tends to expand slightly. Cleaning element 16 is thus held frictionally in place within holes 26. It is preferred that the cleaning element 16 is centered in holes 26 so that a substantially similar length of cleaning element 16 extends from each of the holes 26.

To assemble a scrub brush 10, according to the present invention, a pair of holes 26 are formed or integrally formed in the mounting portion of a base 14. The cleaning elements 16 are pre-cut from an abrasive material. It is preferred that each cleaning element is substantially the same size. A cleaning element 16 is compressed so that it may be pulled through one of the pair of holes 26. The cleaning element 16 is also pulled through the second of the pair of holes 26 so that the cleaning element 16 extends from the base 14 opposite the side of the handle 12. The cleaning element 16 is preferably adjusted so that an equal portion of the cleaning element 16 extends from each of the pair of holes 26. The cleaning element 16 is then released so that a frictional engagement is formed between the edge of the hole 26 and the cleaning element 16 so that the cleaning element 16 is held in place. In this manner, no adhesive has to be used between the cleaning elements and the base.

In use, to clean a surface, a solvent or the like may be applied to the surface to be cleaned or applied directly on the cleaning elements 16. The handle 12 is grasped and the cleaning elements 16 are brought into contact with the surface to be cleaned. An equal pressure may be applied on the cleaning element so that a broad surface area may be cleaned. The force which is distributed by the handle 12 to the base 14 is easily equally distributed to the cleaning elements 16.

While the best mode for carrying out the present invention has been described in detail, those familiar with the art to which this invention relates will recognize various alternative designs and embodiments for practicing the invention as defined by the following claims:

What is claimed is:

1. A scrub brush comprising:

an elongated handle, said handle having a first end and a second end, said handle having a width and a length;

a plurality of cleaning elements formed of netting; and a base having a first side fixedly coupled to said first end and said second end of said handle to form a hand opening between said base and said handle, said base having a second width greater than said width of said handle and a second length greater than the length of said handle, said base having a mounting portion longer and wider than said handle, said mounting portion having a plurality of pairs of holes, each pair of holes corresponding to a respective one of said plurality of cleaning elements;

said plurality of cleaning elements being coupled to said mounting portion through said respective pair of holes so that each of said cleaning elements are frictionally engaged with and extend from said respective pair of holes substantially an equal distance from said mounting portion on a second side of said base opposite said first side.

2. A scrub brush as recited in claim 1, wherein said handle is hollow.

3. A scrub brush as recited in claim 1, wherein said handle and said base are made from plastic.

4. A scrub brush as recited in claim 1, wherein said plurality of cleaning elements are pre-cut before insertion into said base.

5. A scrub brush as recited in claim 1, wherein said netting material is comprised of a nylon material.

* * * * *